US010052681B2

(12) United States Patent
Aoki

(10) Patent No.: US 10,052,681 B2
(45) Date of Patent: Aug. 21, 2018

(54) APPARATUS FOR RECLAIMING FOUNDRY SAND

(71) Applicant: SINTOKOGIO, LTD., Nagoya-shi, Aichi (JP)

(72) Inventor: Yukinori Aoki, Fukuoka (JP)

(73) Assignee: SINTOKOGIO, LTD., Aichi (JP)

( * ) Notice: Subject to any disclaimer, the term of this patent is extended or adjusted under 35 U.S.C. 154(b) by 813 days.

(21) Appl. No.: 14/407,306

(22) PCT Filed: May 9, 2013

(86) PCT No.: PCT/JP2013/063021

§ 371 (c)(1),
(2) Date: Dec. 11, 2014

(87) PCT Pub. No.: WO2014/030398

PCT Pub. Date: Feb. 27, 2014

(65) Prior Publication Data

US 2015/0183025 A1 Jul. 2, 2015

(30) Foreign Application Priority Data

Aug. 23, 2012 (JP) ..... 2012-183748

(51) Int. Cl.
*B22C 5/00* (2006.01)
*B22C 5/10* (2006.01)
(Continued)

(52) U.S. Cl.
CPC ..... *B22C 5/10* (2013.01); *B02C 23/10* (2013.01); *B02C 23/20* (2013.01); *B03B 4/06* (2013.01); *B07B 4/08* (2013.01)

(58) Field of Classification Search
CPC ..... B22C 5/00; B22C 5/04; B22C 5/10
(Continued)

(56) References Cited

U.S. PATENT DOCUMENTS 6,120,284 A * 9/2000 Good et al. ..... B22C 5/08 164/456
2010/0252951 A1* 10/2010 Ina ..... B07B 4/08 264/219

FOREIGN PATENT DOCUMENTS

EP 1 025 926 A2 * 8/2000 ..... B22C 5/02
JP 55-109542 8/1980
(Continued)

OTHER PUBLICATIONS

Extended European Search Report for corresponding EP Application No. 13831775.5 dated Dec. 15, 2015.
(Continued)

*Primary Examiner* — Kevin P Kerns
(74) *Attorney, Agent, or Firm* — Finnegan, Henderson, Farabow, Garrett & Dunner, LLP

(57) ABSTRACT

To provide an apparatus for reclaiming foundry sand that has a fluidized bed that prevents slits from being clogged. The apparatus comprises a tank (3) for reclaiming the foundry sand, a tank (4) for fluidization, an upper portion of which in an upstream side is connected to a bottom of the tank for reclaiming the foundry sand, the tank for fluidization transporting the reclaimed foundry sand and fine powder that drop from the tank for reclaiming the foundry sand, a dust hood (5), and a lower portion of which communicates with an upper portion of the tank for fluidization in a downstream side, the dust hood collecting the fine powder in the tank for fluidization, wherein a fluidized bed (6) in the tank for fluidization has a plurality of inverted V-shaped covering members (13) and a plurality of V-shaped flooring members (14), wherein the inverted V-shaped covering members and the V-shaped flooring members are horizontally and alternately provided so that the inverted V-shaped covering members are at any point above a vertically corresponding point of the V-shaped flooring members, and wherein gaps
(Continued)

between end portions of the inverted V-shaped covering members and end portions of the V-shaped flooring members are formed as inclined slits (15) for supplying air.

5 Claims, 6 Drawing Sheets

(51) Int. Cl.

| | |
|---|---|
| ***B02C 23/10*** | (2006.01) |
| ***B02C 23/20*** | (2006.01) |
| ***B07B 4/08*** | (2006.01) |
| ***B03B 4/06*** | (2006.01) |

(58) Field of Classification Search
USPC ..... 164/412, 5
See application file for complete search history.

(56) References Cited

FOREIGN PATENT DOCUMENTS

| | | |
|---|---|---|
| JP | 10-216896 | 8/1998 |
| JP | 2000-225438 | 8/2000 |
| JP | 3329757 | 7/2002 |
| WO | WO 2011/074628 A1 | 6/2011 |

OTHER PUBLICATIONS

English-language International Search Report from the Japanese Patent Office for International Application No. PCT/JP2013/063021 dated Jul. 16, 2013.

* cited by examiner

Prior Art

APPARATUS FOR RECLAIMING FOUNDRY SAND

TECHNICAL FIELD

The present invention relates to an apparatus for reclaiming foundry sand by stripping the binders on the surfaces of the particles of the foundry sand that is used (for example, self-hardening foundry sand).

BACKGROUND ART

In conventional apparatuses for reclaiming foundry sand, the following process has been known to remove dust that is generated when reclaiming the foundry sand: forming a fluidized layer by blowing air into the foundry sand that includes dust; blowing the foundry sand and dust up and into a dust hood for classifying the sand and dust; and classifying them by the differences in the rates at which they settle (for example, Japanese Patent No. 3329757). As a fluidized bed for forming the fluidized layer the structure as in FIG. 6 has been used: That is, slits 101 for upwardly blowing air are formed in a plate with slits 100. If the particles of the sand that have piled around the slits 101 drop through the slits 101 when air stops being blown, they remain on backup plates 102 that are provided under the slits 101. Then when air starts to again be blown they are ejected from the slits 101. together with the air.

However, by the above-mentioned structure of the fluidized bed, the particles of the sand that enter the slits 101 become compressed to thereby form an arch so that clogging 103 is generated in the slits 101. Thus a problem occurs whereby a regular cleaning is required.

DISCLOSURE OF INVENTION

The present invention was developed to solve that problem. Its purpose is to provide an apparatus for reclaiming foundry sand that has a fluidized bed that prevents slits from being clogged.

To achieve the purpose, the apparatus for reclaiming foundry sand of the present invention comprises a tank for reclaiming the foundry sand by stripping binders on the surfaces of the particles of the foundry sand. It also comprises a tank for fluidization, the upper portion of which in the upstream side is connected to the bottom of the tank for reclaiming the foundry sand. The tank for fluidization transports the reclaimed foundry sand and the fine powder that drop from the tank for reclaiming the foundry sand. It also comprises a dust hood, the lower portion of which communicates with the upper portion of the tank for fluidization in the downstream side. The dust hood collects the fine powder in the tank for fluidization. A fluidized bed in the tank for fluidization has a plurality of inverted V-shaped covering members and a plurality of V-shaped flooring members. The inverted V-shaped covering members and the V-shaped flooring members are horizontally and alternately provided so that the inverted V-shaped covering members are at any point above a vertically corresponding point of the V-shaped flooring members. Gaps between the end portions of the inverted V-shaped covering members and the end portions of the V-shaped flooring members are formed as inclined slits for supplying air.

By the apparatus for reclaiming foundry sand of the present invention the inverted V-shaped covering members and the V-shaped flooring members may be horizontally and alternately provided so that the inverted V-shaped covering members are at any point above a vertically corresponding point of the V-shaped flooring members in a section that is perpendicular to the direction for transporting the reclaimed foundry sand and the fine powder in the tank for fluidization.

By the apparatus for reclaiming foundry sand of the present invention the inverted V-shaped covering members and the V-shaped flooring members may be horizontally and alternately provided so that the inverted V-shaped covering members are at any point above a vertically corresponding point of the V-shaped flooring members in the direction for transporting the reclaimed foundry sand and the fine powder in the tank for fluidization.

By the apparatus for reclaiming the foundry sand of the present invention members for appropriately modifying the airflow may be provided at spaces at the bottom of each of the V-shaped parts of the V-shaped flooring members.

By the apparatus for reclaiming foundry sand of the present invention the members for appropriately modifying the airflow may be round bars.

Since the apparatus for reclaiming foundry sand comprises a tank for fluidization, the upper portion of which in the upstream side is connected to the bottom of the tank for reclaiming the foundry sand, and which tank transports the reclaimed foundry sand and the fine powder that drop from the tank for reclaiming the foundry sand, comprises a tank for fluidization, the upper portion of which in the upstream side is connected to the bottom of the tank for reclaiming the foundry sand, and which tank transports the reclaimed foundry sand and the fine powder that drop from the tank for reclaiming the foundry sand, and comprises a dust hood, the lower portion of which dust hood communicates with the upper portion of the tank for fluidization in the downstream side, and which dust hood collects the fine powder in the tank for fluidization, wherein a fluidized bed in the tank for fluidization has a plurality of inverted V-shaped covering members and a plurality of V-shaped flooring members, wherein the inverted V-shaped covering members and the V-shaped flooring members are horizontally and alternately provided so that the inverted V-shaped covering members are at any point above a vertically corresponding point of the V-shaped flooring members, and wherein gaps between the end portions of the inverted V-shaped covering members and the end portions of the V-shaped flooring members are formed as inclined slits for supplying air, advantageous effects, such as preventing the slits from being clogged, can be achieved.

The basic Japanese patent application, No. 2012-183748, filed Aug. 23, 2012, is hereby incorporated by reference in its entirety in the present application.

The present invention will become more fully understood from the detailed description given below. However, the detailed description and the specific embodiments are only illustrations of the desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

BEST MODE FOR CARRYING OUT THE INVENTION

Figure 1:
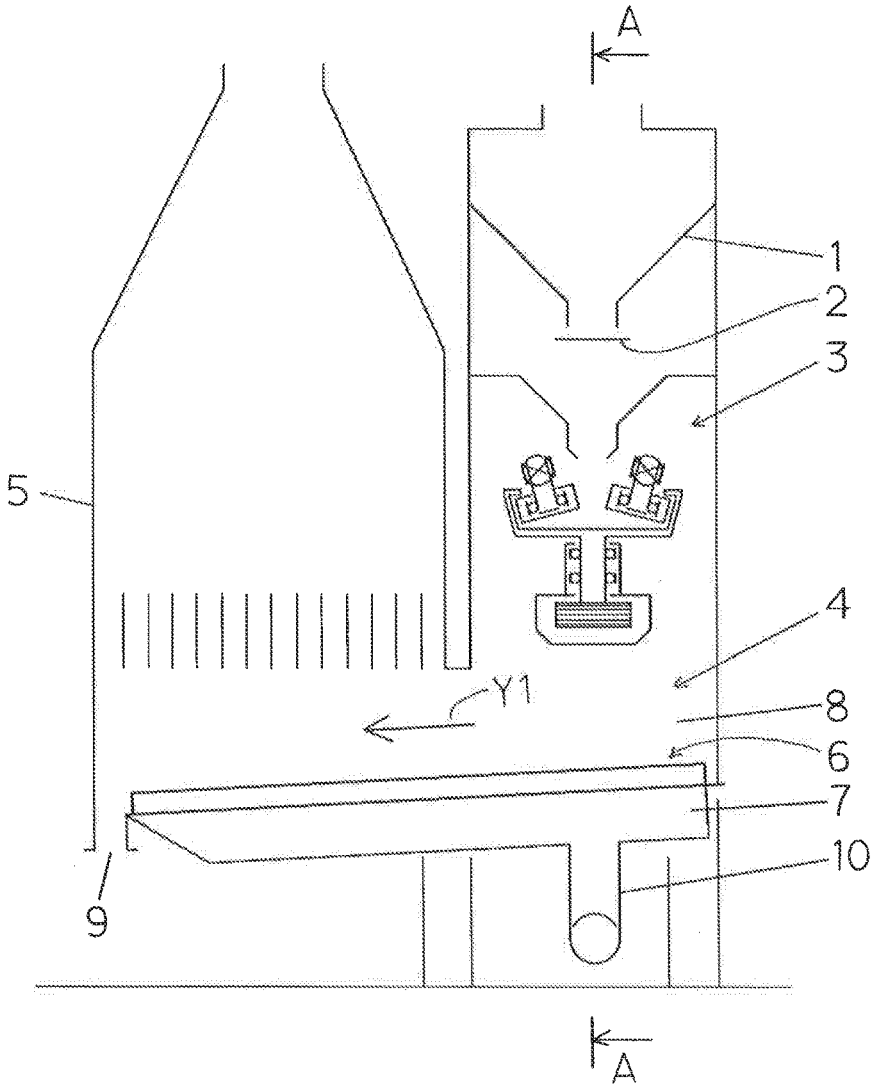
FIG. 1 is a front sectional view of an embodiment of the apparatus for reclaiming foundry sand of the present invention.
Figure 2:
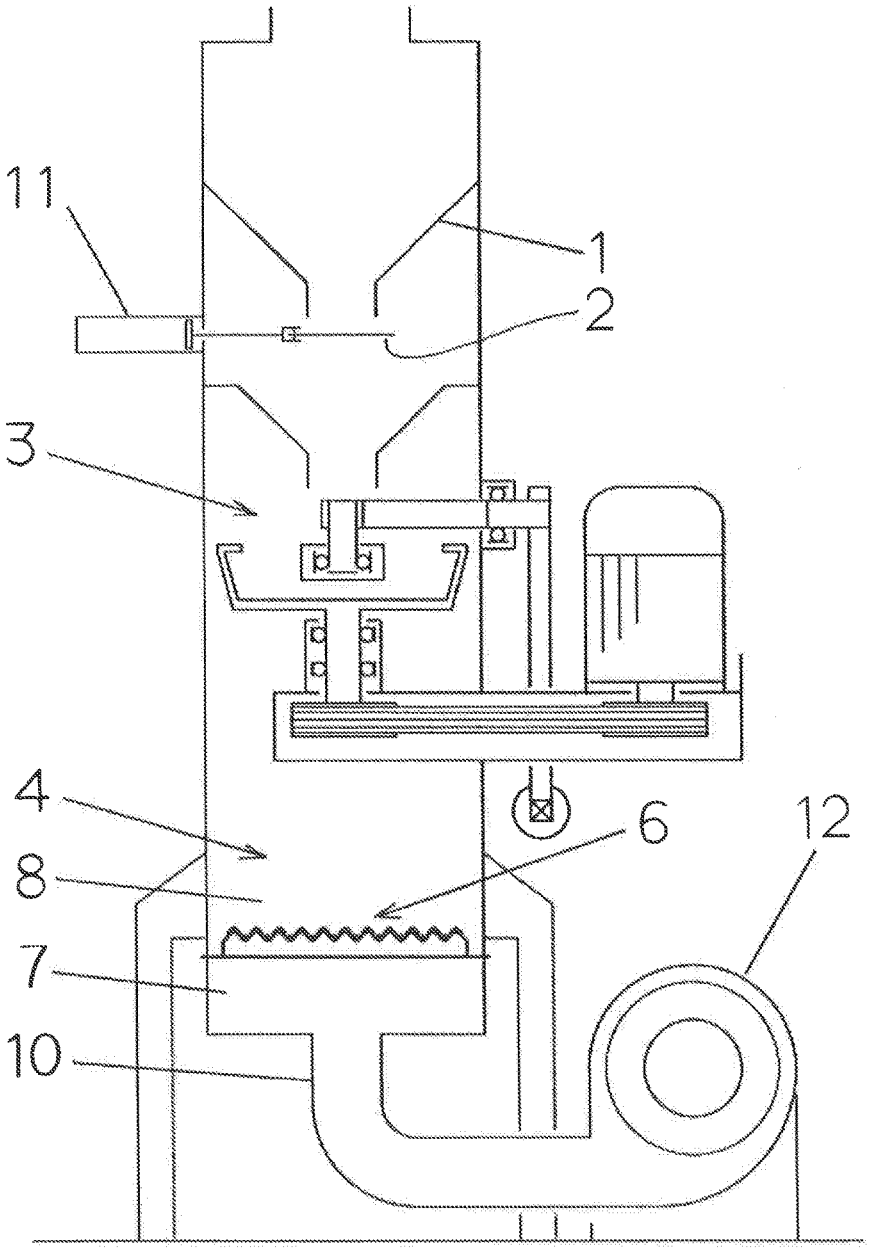
FIG. 2 is a view taken along the line A-A of FIG. 1.

Below, an embodiment of the present invention is discussed with reference to the drawings. By this embodiment, reclaiming self-hardening foundry sand that has been used in a process for self-hardening molding by using alkali phenol is discussed as an example. First, the entire structure of an apparatus for reclaiming self-hardening foundry sand is discussed. In FIG. 1 the number "1" denotes a hopper for returned foundry sand that stores the self-hardening foundry sand that has been used and returned. A gate 2 is provided at the lower end of the hopper for returned foundry sand 1 so that the gate 2 is opened and closed by a cylinder 11 for opening and closing a gate (see FIG. 2).

The hopper 1 for returned foundry sand is at its lower portion connected to a tank 3 for reclaiming the foundry sand. In the tank 3 for reclaiming the foundry sand the particles of the self-hardening foundry sand that has been fed scrape each other so as to strip off binders on the surfaces of the particles of the self-hardening foundry sand. Thus the self-hardening foundry sand is reclaimed. Incidentally, the term "connected" includes a case where another member is inserted between two members that are connected.

The tank 3 for reclaiming the foundry sand is at its lower portion connected to the upper portion of the upstream side of a tank 4 for fluidization. In the tank 4 for fluidization the reclaimed foundry sand (i.e., the self-hardening foundry sand that has been reclaimed) and fine powder that is dropped from the tank 3 for reclaiming the foundry sand are transported. The upper portion of the downstream side of the tank 4 for fluidization is connected to and communicates with the lower portion of a dust hood 5, so that they can communicate with each other. The upper end of the dust hood 5 is connected to a dust collector (not shown). When the dust collector is activated, the fine powder in the tank 4 for fluidization is collected by the dust hood 5. Here, the terms "upstream" and "downstream" mean "upstream" and "downstream," respectively, in the direction for transporting the self-hardening foundry sand to be processed, the reclaimed foundry sand, or the fine powder that has been stripped.

In the lower portion of the tank 4 for fluidization a fluidized bed 6 is provided. The space under the fluidized bed 6 is formed as a chamber for air 7. A fluidized zone 8 is formed on the bed of the fluidized bed 6. At the downstream end of the fluidized bed 6 a port for discharging the sand 9 is provided, to discharge the reclaimed foundry sand.

The lower portion of the chamber for air 7 is connected to, and communicates with, a duct 10. The duct 10 is connected to, and communicates with, a blower 12 (see FIG. 2).

Figure 3:
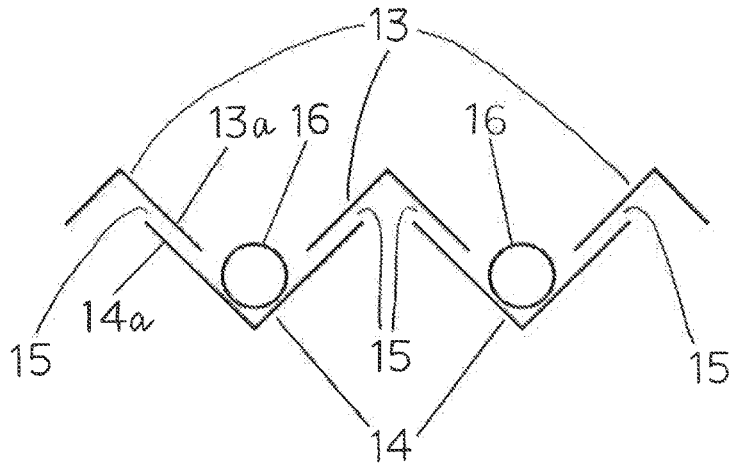
FIG. 3 is a partial and enlarged view of the fluidized bed of FIG. 2.

Next, the configuration of the fluidized bed 6 is discussed in detail. As in FIG. 3 the fluidized bed 6 comprises a plurality of inverted V-shaped covering members 13 and a plurality of V-shaped flooring members 14. They are all formed by an equal leg angle steel. They are horizontally and alternately provided so that the inverted V-shaped covering members 13 are at any point above a vertically corresponding point of the V-shaped flooring members 14. The "inverted V-shaped covering member 13" is a member in which the corner of the angle steel is disposed at the top, and the two sides extend obliquely downward. The "V-shaped flooring member 14" is a member in which the corner of the angle steel is disposed at the bottom and two sides extend obliquely upward. Further, the phrase "the inverted V-shaped covering members 13 are at any point above a vertically corresponding point of the V-shaped flooring members 14" means that the sides of "the inverted V-shaped covering members 13" are partly above the sides of "the V-shaped flooring members 14."

The portions near the tips (also called "end portions") 13*a* of the sides of the inverted V-shaped covering members 13 and the end portions 14*a* of the V-shaped flooring members 14 overlap each other so that vertical gaps are maintained between them. The vertical gaps that are maintained act as inclined slits 15 for supplying air to the fluidized zone 8. At the spaces at the bottom of each of the V-shaped parts of the V-shaped flooring members 14, round bars 16, which are made of steel or the like, are provided so that they act as members for appropriately modifying the airflows that are blown through the slits 15. The round bars 16 are provided so as to maintain the gaps away from the inner surfaces of each of the V-shaped flooring members 14.

In this embodiment, the inverted V-shaped covering members 13 and the V-shaped flooring members 14 are provided horizontally and alternately so that the inverted V-shaped covering members 13 are at any point above a vertically corresponding point of the V-shaped flooring members 14 in a section (the section in FIG. 2) that is perpendicular to the direction for transporting the reclaimed foundry sand and the fine powder (the arrow Y1 in FIG. 1) in the tank 4 for fluidization.

As in FIG. 1, the inverted V-shaped covering members 13 and the V-shaped flooring members 14 are provided in all parts along the longitudinal direction. They are inclined so as to gradually become lower as they approach the downstream ends. Though the round bars 16 are omitted in FIG. 1, they are provided in all parts along the longitudinal direction, like the V-shaped covering members 13 and the V-shaped flooring members 14. They are inclined so as to gradually become lower as they approach the downstream ends.

Now the operation of the above-mentioned structure is discussed. First, the gate 2 is opened by the cylinder 11 for opening and closing the gate 2. The predetermined amount of the self-hardening foundry sand that is used and stored in the hopper 1 for returned foundry sand is fed to the tank 3 for reclaiming the foundry sand. Next, the particles of the self-hardening foundry sand that are fed into the tank 3 for reclaiming the foundry sand scrape each other and are ground. Thus the binders on the surfaces of the particles of the self-hardening foundry sand are stripped so that the self-hardening foundry sand is reclaimed.

Then, the fine powder that is generated by grinding the self-hardening foundry sand, i.e., the binders that are stripped and the like, and the self-hardening foundry sand that is reclaimed, i.e., the reclaimed foundry sand, drop from the tank 3 for reclaiming the foundry sand to be fed to the fluidized zone 8 in the tank 4 for fluidization. In the tank 4 for fluidization air is continuously supplied to the chamber for air 7 through the duct 10 by means of the blower 12. Thus air from the chamber for air 7 is continuously blown into the fluidized zone 8 through the slits 15. The upward airflow is generated on the fluidized zone 8 by the air blown through the slits 15. The fine powder and the reclaimed foundry sand in the fluidized zone 8 are raised by that airflow to be moved to the downstream side of the fluidized bed 6, which is inclined (in the direction shown by the arrow Y1 in FIG. 1). Here, the term "transport" includes the meaning that the fine powder and the reclaimed foundry sand move downwardly along the path of the inclination.

By the operation of the dust collector (not shown), an upward airflow toward the dust collector is generated in the dust hood 5. Thus the fine powder, which slowly settles, is captured by the upward airflow and collected in the dust hood 5 while the fine powder and the reclaimed foundry sand are raised and transported within the fluidized zone 8. The fine powder is retrieved by the dust collector. The reclaimed foundry sand, which rapidly settles, is not lifted, but is transported to the end of the fluidized bed 6 so as to be discharged through the port for discharging the sand 9. The reclaimed foundry sand that is discharged is retrieved by a means for retrieving the sand (not shown) to be reused.

By the present invention, the fluidized bed 6 in the tank 4 for fluidization comprises a plurality of the inverted V-shaped covering members 13 and a plurality of the V-shaped flooring members 14. The inverted V-shaped covering members 13 and the V-shaped flooring members 14 are horizontally and alternately provided so that the inverted V-shaped covering members 13 are at any point above a vertically corresponding point of the V-shaped flooring members 14. The gaps between the end portions 13*a* of the inverted V-shaped covering members 13 and the end portions 14*a* of the V-shaped flooring members 14 act as the inclined slits 15 for supplying air.

By the present invention, a plurality of the inclined slits 15 for supplying air to the fluidized zone 8 can be formed. The openings of the slits 15 that face the fluidized zone 8 are downwardly directed. Thus, if the blower 12 is deactivated while the fine powder and the reclaimed foundry sand are raised in the fluidized zone 8, the fine powder and the reclaimed foundry sand drop to the side of the fluidized zone 8, i.e., the V-shaped parts of the V-shaped flooring members 14. Thus an advantage is achieved in preventing the fine powder and the reclaimed foundry sand, from entering the slits 15 to occlude them. As a result, the blower 12 can be deactivated after the reclaiming process in the tank 3 for reclaiming the foundry sand is finished, without waiting for the fine powder in the fluidized zone 8 to be collected or all of the reclaimed foundry sand to be discharged. Thus an advantage is achieved in saving electric power.

By the embodiment of the present invention the members for appropriately modifying the airflow (the round bars 16 in the embodiment) are provided at spaces at the bottom of each of the V-shaped parts of the V-shaped flooring members 14. But the embodiment is not limited to this configuration. The members for appropriately modifying the airflow can be omitted. However, the members for appropriately modifying the airflow are preferably provided. Below, this point is discussed.

If no member for appropriately modifying the airflow is provided at spaces at the bottom of each of the V-shaped parts of the V-shaped flooring members 14, airflows that are blown through the slits 15 that face each other collide, to thereby generate turbulence. By contrast, if the members for appropriately modifying the airflow are provided at spaces at the bottom of each of the V-shaped parts of the V-shaped flooring members 14, airflows that are blown through the slits 15 that face each other collide with the members for appropriately modifying the airflow, to be shifted in the directions to flow. Thus the airflows do not collide with each other. Thus the airflows are properly modified, to reduce turbulence. An advantage is achieved in improving the removal of the fine powder. Further, the particles of the reclaimed foundry sand collide with the members for appropriately modifying the airflow. Thus an advantage is achieved in knocking off the fine powder that attaches to the particles.

Though in the embodiment of the present invention the members for appropriately modifying the airflow are provided at spaces at the bottom of each of the V-shaped parts of the V-shaped flooring members 14 so that the gaps are kept between them and the inner surfaces of the V-shaped flooring members 14, the embodiment is not limited to this configuration. The members for appropriately modifying the airflow may be disposed to contact the inner surfaces of the V-shaped flooring members 14.

Though in the embodiment of the present invention the round bars 16 are used for the members for appropriately modifying the airflow, the embodiment is not limited to this configuration. A square bar, a hexagonal bar, a pentagonal bar, etc., can be used for the members for appropriately modifying the airflow. However, the round bar 16 is preferably used for the members for appropriately modifying the airflow. Below, this point is discussed.

Figure 4:
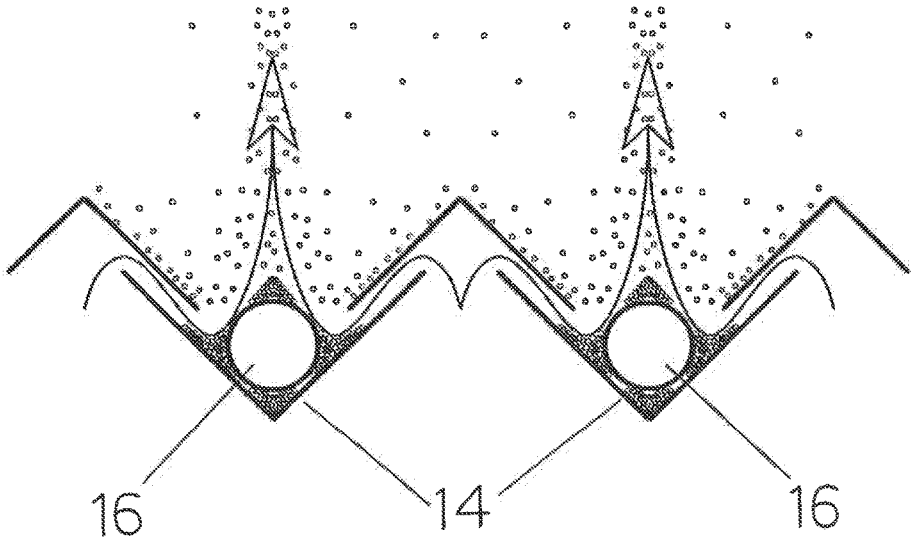
FIG. 4 is a partial and enlarged view of the fluidized bed of FIG. 2 that illustrates airflows from the slits that are disposed opposite the round bars that are provided at spaces at the bottom of each of the V-shaped parts of the V-shaped flooring members.

As in FIG. 4, if the round bar 16 is provided at spaces at the bottom of each of the V-shaped parts of the V-shaped flooring members 14 as the members for appropriately modifying the airflow, drifts of the reclaimed foundry sand that are static at the lower portions of the two sides of the round bar 16 are generated. The upper surfaces of the drifts are smoothly curved near the round bar 16. The airflow that is blown through the slit 15 that faces the round bar 16 is guided by the curved surface to flow upward. Thus the airflows are directed in the same direction. Thus an advantage is achieved in reducing turbulence compared to where airflows freely collide with each other.

As discussed above, in the embodiment of the present invention the inverted V-shaped covering members 13 and the V-shaped flooring members 14 are horizontally and alternately provided so that the inverted V-shaped covering members 13 are at any point above a vertically corresponding point of the V-shaped flooring members 14 in a section (the section in FIG. 2) perpendicular to the direction for transporting the reclaimed foundry sand and the fine powder in the tank 4 for fluidization (the direction shown by the arrow Y1 in FIG. 1). However, the present invention is not limited to this configuration. The inverted V-shaped covering members 13 and the V-shaped flooring members 14 may be horizontally and alternately provided so that the inverted V-shaped covering members 13 are at any point above a vertically corresponding point of the V-shaped flooring members 14 in the direction for transporting the reclaimed foundry sand and the fine powder in the tank 4 for fluidization (the direction shown by the arrow Y1 in FIG. 1), i.e., in the section shown in FIG. 1.

By configuring the device as discussed above, the fine powder and the reclaimed foundry sand flow while moving over the inverted V-shaped parts of the covering members 13. Thus the time to completely discharge the reclaimed foundry sand is increased. However, the number of collisions of the particles of the reclaimed foundry sand against the inverted V-shaped parts of the covering members 13 increases. Thus the fine powder that attaches to the particles is effectively knocked off. Thus the fine powder and the reclaimed foundry sand can be definitely separated (classified).

Figure 5:
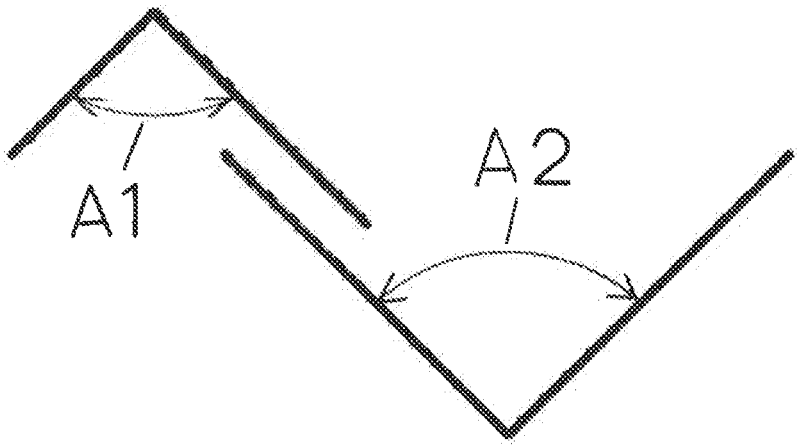
FIG. 5 is a partial and enlarged view that illustrates the angles of the inverted V-shaped parts of the inverted V-shaped covering members and V-shaped parts of the V-shaped flooring members.
Figure 6:
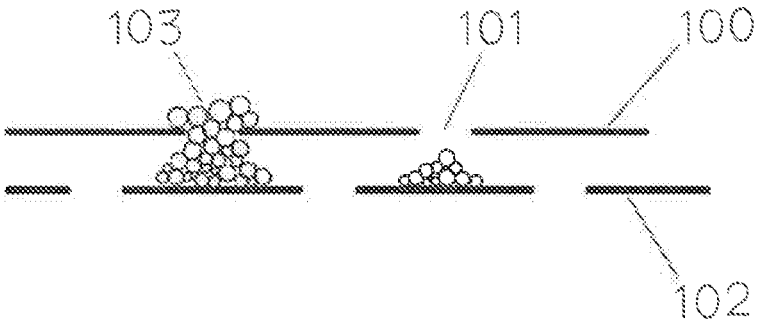
FIG. 6 is a view illustrating the structure of a conventional fluidized bed.

Further, in the embodiment of the present invention both the inverted V-shaped covering members 13 and the V-shaped flooring members 14 are made of equal leg angle steels. The angle A1 of the corner of the inverted V-shaped part and the angle A2 of the corner of the V-shaped part are each 90 degrees (see FIG. 5). However, the embodiment is not limited to this configuration. The inverted V-shaped covering members 13 and the V-shaped flooring members 14 may be manufactured by bending a steel plate. The angles A1, A2 are not limited to 90 degrees.

Further, in the embodiment of the present invention an example is discussed where the self-hardening foundry sand that is used in a process for self-hardening molding by using alkali phenol is reclaimed. The present invention is not limited to this use. The present invention can be applied not only to reclaim the self-hardening foundry sand that is used in a process for self-hardening molding by using an organic substance, but also to reclaim the self-hardening foundry sand that is used in a process for self-hardening molding by using an inorganic substance. Incidentally, processes for self-hardening molding by using an organic substance to which the present invention is applied include, for example, the process for self-hardening molding by using alkali phenol, which is discussed above, and a process for self-hardening molding by using an inorganic substance, such as phenol urethane. Processes for self-hardening molding by using an inorganic substance to which the present invention can be applied include, for example, a process for self-hardening molding by using an inorganic substance that uses liquid glass.

Further, the present invention is not limited to being applied to reclaiming self-hardening foundry sand. It can be applied to reclaiming foundry sand such as green sand, foundry sand that uses an organic hinder, and foundry sand that uses an inorganic binder.

Below, the main reference numerals and symbols that are used in the detailed description and drawings are listed.

1: a hopper for returned foundry sand
3: a tank for reclaiming the foundry sand
4: a tank for fluidization
5: a dust hood
6: a fluidized bed
13: an inverted V-shaped covering member
13*a*: an end portion of the inverted V-shaped covering member
14: a V-shaped flooring member
14*a*: an end portion of the V-shaped flooring member
15: a slit
16: a member for appropriately modifying the airflow
Y1: the direction for transporting the reclaimed foundry sand and the fine powder in the tank for fluidization

The invention claimed is:

1. An apparatus for reclaiming foundry sand comprising:
a tank for reclaiming the foundry sand by stripping binders on surfaces of particles of the foundry sand;
a tank for fluidization, an upper portion of which in an upstream side is connected to a bottom of the tank for reclaiming the foundry sand, the tank for fluidization transporting the reclaimed foundry sand and fine powder that drop from the tank for reclaiming the foundry sand;
a dust hood, a lower portion of which communicates with an upper portion of the tank for fluidization in a downstream side, the dust hood collecting the fine powder in the tank for fluidization;
wherein a fluidized bed in the tank for fluidization has a plurality of inverted V-shaped covering members and a plurality of V-shaped flooring members,
wherein the inverted V-shaped covering members and the V-shaped flooring members are horizontally and alternately provided so that the inverted V-shaped covering members are at any point above a vertically corresponding point of the V-shaped flooring members, and
wherein gaps between end portions of the inverted V-shaped covering members and end portions of the V-shaped flooring members are formed as inclined slits for supplying air.

2. The apparatus for reclaiming foundry sand of claim 1, wherein the inverted V-shaped covering members and the V-shaped flooring members are horizontally and alternately provided so that the inverted V-shaped covering members are at any point above a vertically corresponding point of the V-shaped flooring members in a section that is perpendicular to a direction for transporting the reclaimed foundry sand and the fine powder in the tank for fluidization.

3. The apparatus for reclaiming foundry sand of claim 1, wherein the inverted V-shaped covering members and the V-shaped flooring members are horizontally and alternately provided so that the inverted V-shaped covering members are at any point above a vertically corresponding point of the V-shaped flooring members in a direction for transporting the reclaimed foundry sand and the fine powder in the tank for fluidization.

4. The apparatus for reclaiming the foundry sand of any one of claims 1, 2, and 3, wherein members for appropriately modifying airflow are provided at spaces at a bottom of each of V-shaped parts of the V-shaped flooring members.

5. The apparatus for reclaiming foundry sand of claim 4, wherein the members for appropriately modifying airflow are round bars.

* * * * *